United States Patent [19]

Sergan

[11] Patent Number: 5,056,384

[45] Date of Patent: Oct. 15, 1991

[54] TORQUE WRENCH

[75] Inventor: Anthony J. Sergan, Farmington, Conn.

[73] Assignee: Barnes Group Inc., Bristol, Conn.

[21] Appl. No.: 526,927

[22] Filed: May 22, 1990

[51] Int. Cl.[5] ..... B25B 13/40

[52] U.S. Cl. ..... 81/57.39

[58] Field of Search ..... 81/57.39, 57.4, 467, 81/478, 481; 29/407

[56] References Cited

U.S. PATENT DOCUMENTS

| | | | |
|---|---|---|---|
| 1,970,179 | 8/1934 | Miller . | |
| 2,069,882 | 2/1937 | Hall . | |
| 2,299,956 | 10/1942 | Stever . | |
| 2,910,901 | 11/1959 | Ryd . | |
| 2,961,904 | 11/1960 | Sergan . | |
| 3,625,095 | 12/1971 | Barnett et al. . | |
| 3,686,983 | 8/1972 | Flagge . | |
| 3,868,872 | 3/1975 | Wing . | |
| 4,137,800 | 2/1979 | Austin . | |
| 4,398,598 | 8/1983 | Fabrygel | 81/57.39 |
| 4,409,865 | 10/1983 | Krautter et al. . | |
| 4,506,567 | 3/1985 | Makhlouf . | |
| 4,706,527 | 11/1987 | Junkers . | |
| 4,744,271 | 5/1988 | Collins . | |
| 4,838,130 | 6/1989 | Synder . | |

FOREIGN PATENT DOCUMENTS

| | | | |
|---|---|---|---|
| 957918 | 11/1974 | Canada . | |
| 747709 | 7/1980 | U.S.S.R. | 81/57.39 |

*Primary Examiner*—James G. Smith

*Attorney, Agent, or Firm*—Pennie & Edmonds

[57] ABSTRACT

A torque wrench in which the torquing forces are applied to the article torqued equally and oppositely in a diametrically opposed manner. The body of the wrench comprises a two-part metal frame which permits the wrench to be significantly lighter than prior art wrenches. The applied forces are provided by four hydraulic cylinders mounted in a frame, equally spaced about a central opening in which the member to be torqued is gripped. The fluid power cylinders apply force to the legs of a rotatable drive means which, in turn, rotates the member torqued. In order to provide rotation in both directions, each cylinder of the wrench is pivotable to engage two adjacent legs of the drive means and thereby permit the drive means to selectively rotate in opposite directions. The hydraulic wrench according to the invention is provided with a self-contained hydraulic system in order to create a completely portable unit which is generally free from hydraulic contamination.

28 Claims, 8 Drawing Sheets

TORQUE WRENCH

BACKGROUND OF THE INVENTION

The invention relates to torque wrenches and more particularly to a light weight, self-contained, portable torque wrench wherein the torquing force is supplied by fluid power cylinders arranged such that equal, diametrically opposed forces are applied to the part being torqued without induced side loading.

Many current applications require high torquing forces to be applied with great precision, while simultaneously maintaining a precision alignment of the parts being joined. This is true, for example, in the assembly and repair of jet engines and other high speed machinery. It has been found that prior art torque wrenches, such as those discussed below, can not always meet these requirements. A typical prior art design utilizes an offset, single mechanical moment arm or single hydraulic ram assembly which has the tendency to cause side loading, especially at high torques. Such side loading can lead to bending or eccentricity of the parts being joined. Even a slight eccentricity, for example, in a turbine shaft, can cause unacceptable run-out with an attendant increase in engine vibration, leading to premature engine failure.

In the field of torque wrenches there is a wide selection of known wrenches designed for particular applications. Even in the somewhat narrower field of fluid power torque wrenches there is a great variety of designs. U.S. Pat. No. 4,137,800 to Austin, for example, discloses a torque wrench in which a hydraulic cylinder forces a slide block against a single torque arm causing the rotation of a ratchet mechanism. U.S. Pat. No. 3,686,983 to Flagge discloses a torque-applying device wherein the torquing force is supplied by an hydraulic motor. One example of a specialized torque wrench available in the prior art is disclosed in U.S. Pat. No. 4,838,130 to Snyder which describes a hydraulically actuated power wrench specifically adapted for torquing one of a plurality of adjacently spaced bolts. The Snyder '130 wrench comprises a hydraulic cylinder which acts on a pivotable lever to turn a bolt. The reaction force due to the application of torque is borne by an adjacent bolt through a specially shaped anchoring ring. U.S. Pat. Nos. 3,868,872 and 4,706,527 illustrate further examples of torque wrenches where the torquing force is provided by a hydraulic cylinder acting through a lever arm.

U.S. Pat. No. 2,961,904 discloses a hydraulically actuated wrench which attempts to address the failings of the prior art by applying a balanced torquing force. The subject wrench is provided with a central drive member having a ratcheted opening for engaging a nut. The drive member also has three arms equally spaced at 120 degree intervals extending radially from the drive member. Three pairs of fixed, opposed hydraulic cylinders act on these arms to provide the torquing force. The cylinders are equally spaced about the drive member in order to exert a balanced force on the work piece. The cylinders are arranged in opposed pairs in order to enable the wrench to operate in either direction, i.e., three cylinders exert a clockwise force and three exert a counter-clockwise force.

While the patented wrench disclosed in the '904 patent is an improvement over the previously available wrenches in that it applies a generally balanced torquing force, its design is still not satisfactory for all applications. The triangular arrangement of the cylinders, while generally providing balanced forces, is inherently somewhat unstable due to the fact that each cylinder, acting on the work piece through the drive member, is not directly opposed by an equal reaction force. Therefore, the possibility exists for side loading to occur, causing the piston to creep on the arm of the drive member. Such creep would change the effective length of the moment arm and thus cause inaccurate torque readings.

Another disadvantage of a design using opposed cylinders for supplying torquing forces in two directions is the precision machining which is required to fabricate such a wrench. In order for the torque readings to be accurate in both directions, the center lines of the opposed cylinders must match exactly. If the center lines do not match, there will be different effective moment arms depending on which cylinder is acting. It is expensive and time consuming to precision line bore the required seat for the opposed cylinders. In large wrenches, requiring large diameter bores, the tolerance requirements alone may be sufficient to cause a center line mismatch.

In addition, paired cylinders such as are found in the '904 wrench require two travel limit valves to prevent piston over travel. This extra hydraulic valving and attendant piping must be placed on the outside of the wrench as a result of design size considerations. The valving and piping is therefore subject to damage and leaking when the wrench is used under normal field conditions.

A further disadvantage of the prior art wrenches discussed above is that in order to achieve a large torque capacity, the weight and size of these wrenches are such that they are bulky and cumbersome to use. This is especially true of the wrench of the '904 patent because six cylinders are included while only three at a time are used for a particular torquing operation. This greatly increases the weight of the wrench. Portability is a very important feature in torque wrenches as described herein, especially if the wrench is to be successfully utilized at remote field installations as is required in the offshore oil industry and in many military applications.

SUMMARY OF THE INVENTION

Thus, it is an object of the invention to provide a torque wrench which applies equal, centrally balanced, diametrically opposed forces to the part being torqued in order to prevent side loading, bending or eccentricities and thereby eliminate false torque readings and ensure the greatest possible accuracy in torque application. Therefore, a feature of the invention is the arrangement of fluid power cylinders in opposed pairs, each pair acting through parallel lines spaced equidistantly apart across the center of the wrench. Thus, the lines of action of all cylinders are equidistant from the center of the wrench. This feature provides the advantage that equal, centrally balanced and diametrically opposed forces are applied automatically and in all situations.

A further object of the invention is to provide such an accurate torque wrench suitable for use in tight areas which is also portable, compact, and lightweight. A feature of the invention is therefore to provide means for rotating the fluid power cylinders to act in one of two directions, 90° apart. This has the advantage of allowing each cylinder to create a torque in both the clockwise and counterclockwise direction and thus reducing the weight and size of the wrench by eliminating redundant components. A further feature in this respect is a lightweight frame, which includes integral fluid passages. This provides the advantage of minimum weight while maintaining structural integrity and also minimizing the number of weight adding fluid fittings.

It is also an object of the invention to provide a hydraulic torque wrench with a minimum of external fluid fittings and components. Thus, a frame provided with internal integral fluid passages and integral bosses for attachment of main fluid components is a feature of the invention. In a preferred embodiment, a further feature in this respect is a hydraulic pump having an integral fluid reservoir which is fastened directly to the frame and generally lies within the outer limits of the frame. These features provide the advantage that external fluid fittings and components are minimized and therefore the possibility of damage and leakage is reduced.

In general, these and other objects are achieved by a torque wrench comprising a frame; drive means for converting linear force to angular force and for engaging a device to be rotated mounted centrally in the frame; means for applying equal and diametrically opposed linear forces to the drive means; and selector means for selectively rotating the direction of application of the force applying means.

The frame generally comprises two separate frame members, each member itself comprising a central support member, defining a central aperture and further defining passages therethrough for the actuating fluid. The frame also comprises individual truss members joining the central support member with an outer ring member.

The drive means comprises a cylindrical body having a central bore with a gear tooth interior surface and, in a preferred embodiment, four legs extending radially from and equally spaced around the outer circumference of the cylindrical body. A ratchet wheel is rotatably supported within the central bore and adapted to engage a tool for connection with the device that is to be rotated. A number of pawls are pivotably supported on the ratchet wheel. The pawls are spring biased to engage the gear tooth interior surface of the central bore to provide driving engagement between the cylindrical body and the ratchet wheel. The pawls may be selectively positioned to provide driving engagement in a clockwise direction or in a counterclockwise direction.

The force-applying means comprises a plurality of fluid power cylinders disposed on the frame in opposed pairs acting through parallel lines spaced equidistantly apart across the central aperture of the wrench. The pistons of the cylinders engage alternately one of two adjacent legs of the drive means and apply equal, diametrically opposed linear forces to the drive means equidistant from its center. The force-applying means also includes a system for supplying fluid to cylinders, comprising internal fluid supply lines formed integrally with the frame and a selector valve for selectively directing the actuating fluid under pressure to the cylinders in order to provide a power stroke, a return stroke and a normally open state. In a preferred embodiment the fluid passages communicate with a dual acting hydraulic hand pump that has an integral fluid reservoir. Thus, the wrench is capable of operation on remote sights or hazardous areas with the integral hand pump or with attachment of high pressure hydraulic hose lines and a separate motor driven pump.

In the preferred embodiment the selector means comprises a ring which is rotatably mounted on the frame and rotates about the central vertical axis of the wrench. The ring is provided with a number of perpendicularly extending pins, the number of which corresponds to the number of cylinders. The pins slideably cooperate with each cylinder to rotate the cylinder when the ring is rotated. The ring may be rotated itself by a drive gear. The pump handle may be detached from the pump and used to power the drive gear. The pump handle also serves as a carrying handle for the wrench during transport.

BRIEF DESCRIPTION OF THE DRAWINGS

The features and advantages of the invention will be more readily apparent from following the detailed description of the preferred embodiments illustrated in the drawing figures, wherein.

DETAILED DESCRIPTION OF THE PREFERRED EMBODIMENT

Figure 1:
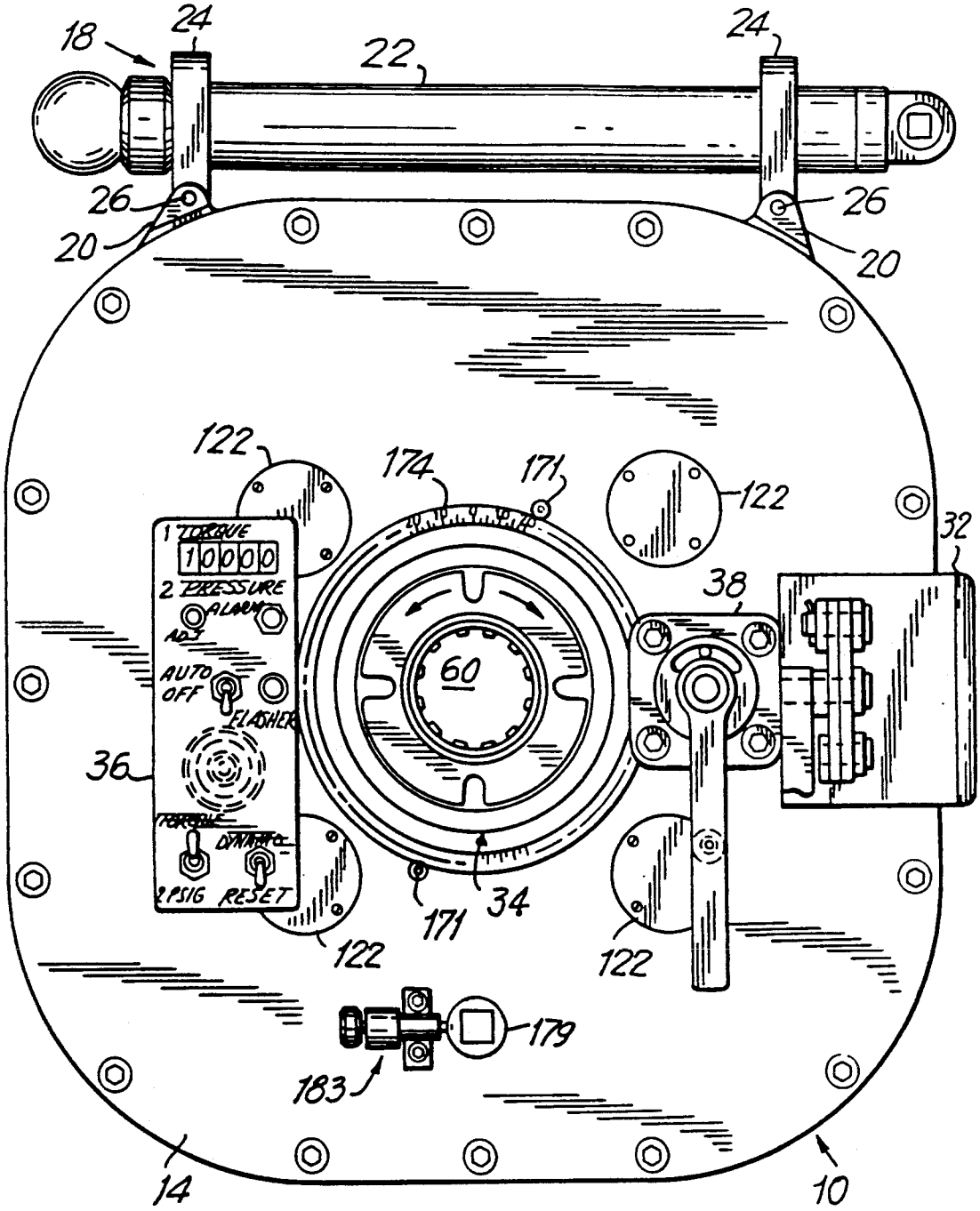
FIG. 1 is a top plan view of the hydraulic torque wrench of the present invention.

Referring to the illustrations and particularly to FIG. 1 it can be seen that a preferred embodiment of the hydraulic torque wrench 10 of the invention generally includes front structural frame member 14 (a rear structural frame member 16 is not visible in this figure), a handle assembly 18, pump 32, four leg ratchet mechanism 34, transducer pressure gauge 36 and four-way selector valve 38.

Figure 2:
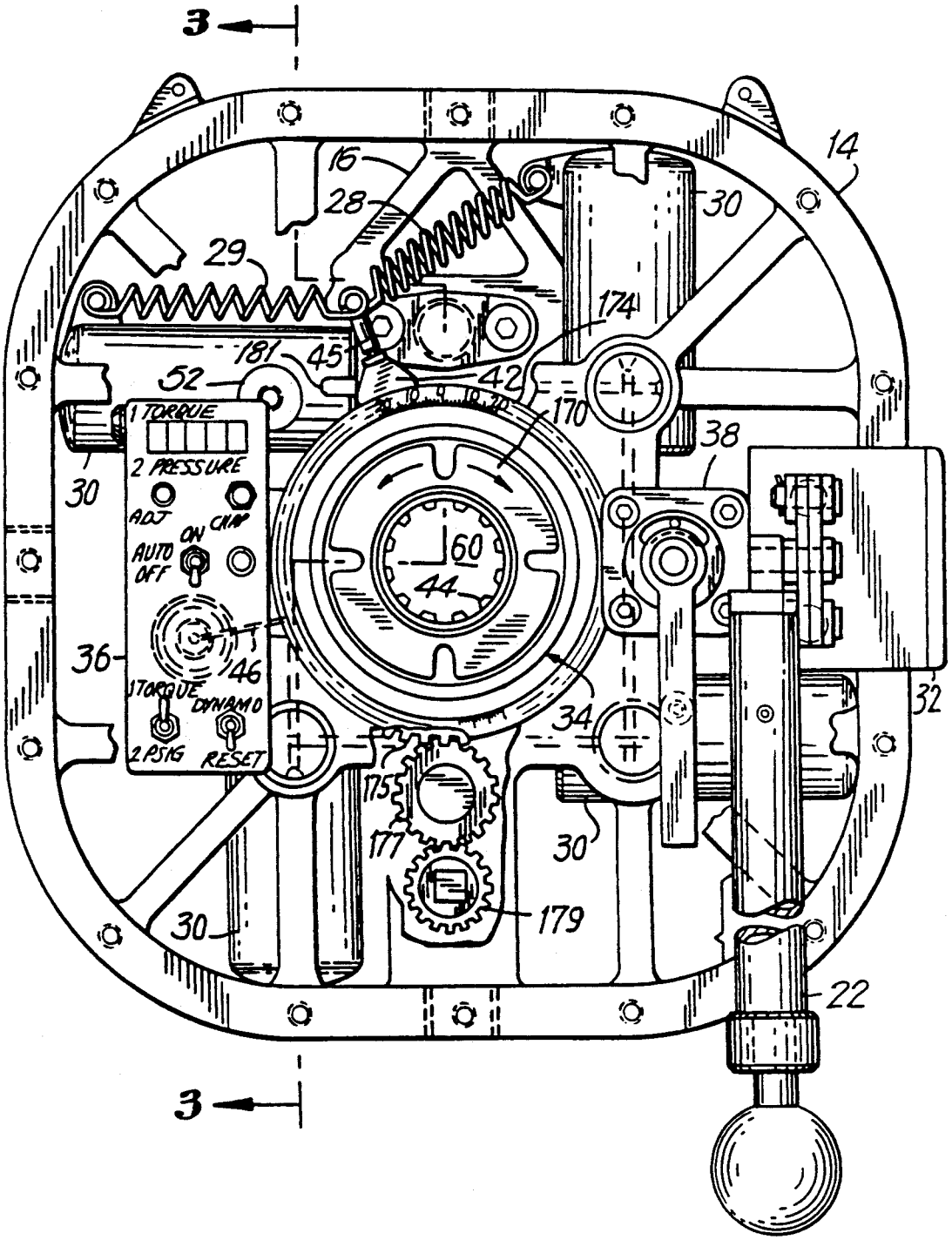
FIG. 2 is a top plan view of the present invention with the majority of the front frame member broken away.

The handle assembly 18 comprises a removable telescoping pump handle 22 (which may be removed and used to actuate the pump 32 as shown in FIG. 2) and two hook shaped supports 24 which are removably secured to the wrench 10 by spring pins 26 which extend through eyes in brackets 20.

Figure 3:
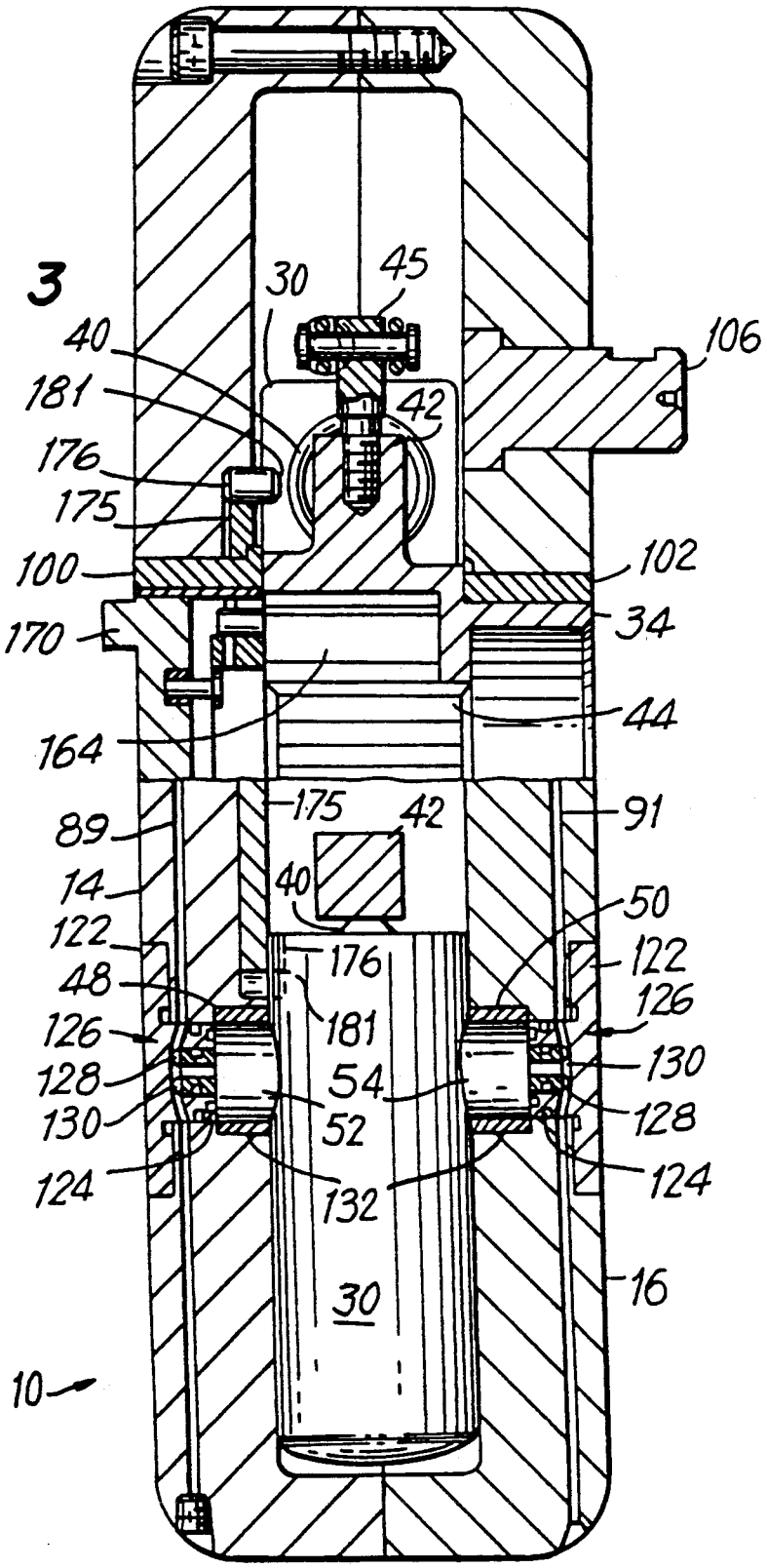
FIG. 3 is a section view through line 3—3 of FIG. 2.

Turning to FIGS. 2 and 3, the main components of the wrench 10 can be seen more clearly. These main components generally comprise front and rear frame members 14,16, four fluid power cylinders 30, pump 32, four-leg ratchet mechanism 34, transducer pressure gauge 36 and four-way selector valve 38. The front and rear frame members 14,16 serve the dual purposes of providing structural support for the wrench 10 and providing passages for the actuating fluid.

Before addressing further details of the invention, it is appropriate to first provide a brief overview of the construction and operation of the wrench 10 in order to gain a general understanding of the purpose of and relationship between the main components, which subsequently will be described in detail. Referring still to FIGS. 2 and 3, four fluid power cylinders 30 are located in a square configuration ninety (90) degrees apart surrounding the ratchet mechanism 34. The cylinders 30 provide means for applying equal and diametrically opposed forces to the legs 42 of the four-leg ratchet mechanism 34 mounted in the center of the wrench 10. The four-leg ratchet mechanism 34 provides means for converting the linear force applied by the pistons 40 to an angular or torquing force. The four-leg ratchet mechanism 34 is provided with a central splined ring 44 for accepting a tool which engages the part to be torqued. Fluid power to the cylinders 30 is provided by a dual action hand pump 32 which forms an integral part of the wrench 10. From the pump 32, the actuating fluid flows through passages in the front and rear frame members 14,16 to the cylinders 30. By means of a small pilot hole 46, the transducer pressure gauge 36 senses the pressure exerted by the pump and converts that information to digital torque readings. Return springs 28,29 are provided to return the four-leg ratchet mechanism 34 to its original position after the torque has been applied.

In order to provide both torquing and untorquing forces, using only one set of cylinders and without turning the wrench over, a novel means for rotating the direction of force application of the cylinders 30 is provided. Each cylinder 30 is pivotable such that its piston 40 is capable of bearing on two different legs 42 of the four-leg ratchet mechanism 34, e.g., a first and second leg associated with each cylinder. A rotatable ring 175, driven by drive gear 179, engages the cylinders 30 which are pivotably mounted in the front and rear frame members 14,16. By rotating the drive gear 179, the cylinders 30 may be rotated ninety (90) degrees to bear on the second associated leg of the four-leg ratchet mechanism 34 located ninety (90) degrees away from the first leg and thereby transmit force, and thus torque, in the opposite direction. This operation is explained in detail in connection with FIG. 9, below.

The torque wrench 10 according to the present invention is a universal tool which may be used with many different types of equipment and in many different applications. In order to secure the wrench 10 in each different application, without modifying the wrench itself, the wrench is fitted on a torque reaction adapter (not shown). This adapter is specifically designed for a particular work piece to accept torque reaction loads when torques are applied to the assembly. Shear lugs 106 are provided to secure the wrench 10 to an adapter. Such torque reaction adapters are known in the art and could be easily made to fit the wrench according to the present invention by a person of reasonable and ordinary skill in the art.

Figure 5:
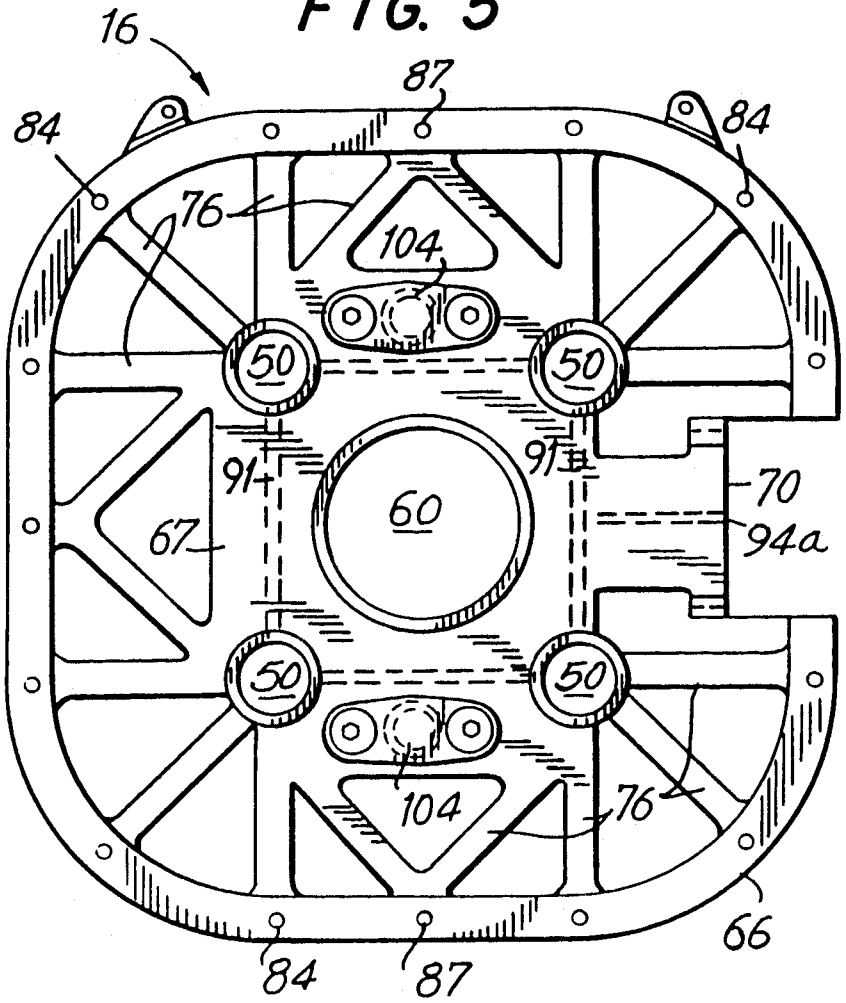
FIG. 5 is a top plan view of the rear frame member.
Figure 4:
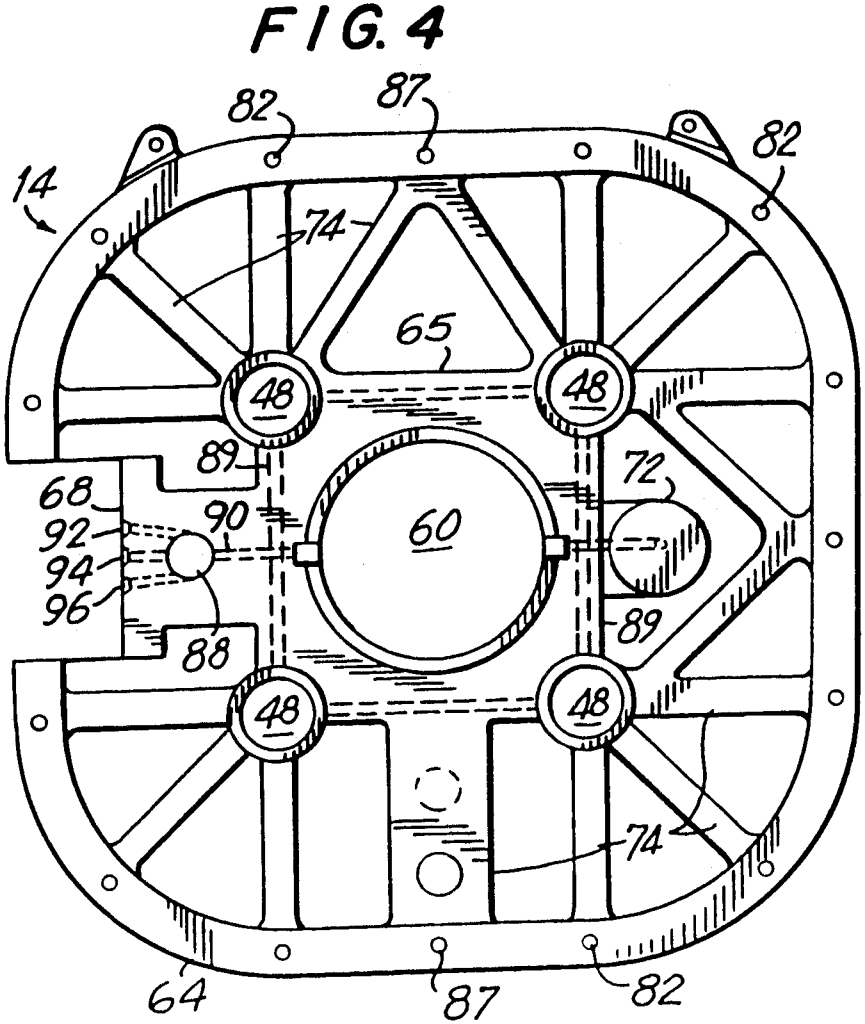
FIG. 4 is a bottom plan view of the front frame member of the present invention.

Referring now to FIGS. 4 and 5, the arrangement and function of the front and rear frame members 14,16 will be discussed in detail. In a preferred embodiment, the front and rear frame members 14,16 are aluminum, made as forgings or castings. If castings are used they may be impregnated with a plastic material in order to eliminate microporosity and thereby prevent leakage of the actuating fluid. Such an impregnation process is commonly used to eliminate porosity in castings utilized in fluid power applications.

The front and rear frame members 14, 16 are each formed as integral parts having outer ring 64,66, central support 65,67, pump boss 68,70 and interior truss members 74,76. In addition, transducer boss 72 is formed on front frame member 14. Apertures 48,50 receive cylinder pivot lugs 52,54 to allow rotation of the cylinders 30 and are formed in the central supports 65,67.

The front and rear members 14,16 are fastened together by bolts through holes 82,84 in the outer rings 64,66. Two dowels are provided in fitted holes 87 on the inside of the outer rings 64, 66 to ensure exact alignment of the frame members and to carry the shear force exerted on the frame members during a torquing operation.

Front and rear frame members 14, 16 define a central opening 60 within the central supports 65, 67. Front and rear bearing 100,102 (see FIG. 3) are located in the central opening 60 respectively on the front and rear members 14,16. On the outside of the rear frame member 16 only are provided two additional bores 104 which carry shear lugs 106. The shear lugs 106 secure the entire wrench 10 to the torque reaction adapter.

Fluid passages 89,91, arranged in a square configuration, are provided in the central supports 65, 67 by forming small holes in the metal. The front frame member 14 includes, with the pump boss 68, a boss 88 for supporting the four-way selector valve 38 and fluid passages 90, 92, 94 and 96 associated therewith. The pressure line leads from the valve boss 88 through passage 90 to the square passage 89 in the central support 65 of the front frame member 14. The square horizontal passage 89 in the front frame member 14 communicates with the cylinders 30. An additional small pilot hole 46 is provided in the front frame member 14 which communicates with transducer 36 through the transducer boss 72. Similarly, the square fluid passage 91 in the rear frame member 16 communicates with apertures 50 to provide a fluid return line. The operation of fluid power circuit is discussed below in detail in conjunction with FIG. 10.

In an alternative, but less preferred embodiment, the front and rear frame members 14, 16 may be replaced by front and rear plates. Such plates are still provided with central opening 60 and apertures 48, 50 for the pivot lugs 52, 54 of the cylinders 30. In order to provide a cavity for the cylinders 30 and the four-leg ratchet mechanism 34, the plates are spaced apart by block shaped spacers bolted between them. These plates form only a structural frame for the internal components of the wrench 10. Therefore, a separate sheet metal outer skin is also provided. The sheet metal skin is bolted to the plates in this alternative embodiment.

Fluid passages may be provided in the plates in a manner similar to those described above in the front and rear frame members 14, 16. Alternately, fluid passages may be provided as annular grooves surrounding the apertures 48, 50 which communicate with annular grooves around the outside of the pivot lugs 52, 54. It will, of course, be apparent to one skilled in the art that the exact arrangement of the fluid passages may vary from that described herein. The preferred embodiment, however, has the advantages of requiring a minimum of both hydraulic seals and special machining.

Figure 6:
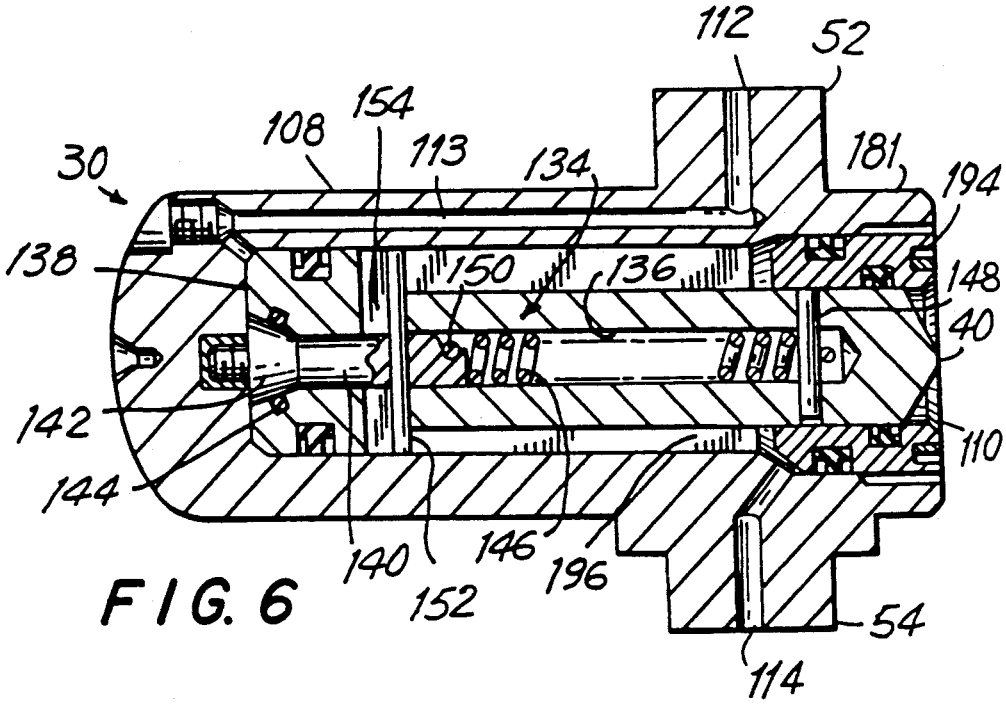
FIG. 6 is a detail section view of a cylinder-piston assembly of the present invention.

Referring to FIGS. 3 and 6, the hydraulic cylinders 30 of the present invention are described in greater detail. In FIG. 3, the cylinder 30 is shown not sectioned in order to eliminate duplication of detail shown in FIG. 6 and thereby enhance the clarity of FIG. 3. Referring first to FIG. 6, each cylinder 30 comprises a cylinder body 108 which supports the piston 40 and provides passages 112, 113, 114, drilled in the cylinder body 108, for the actuating fluid. Each cylinder generally has a "T"-shape, with pivot lugs 52,54 extending from each side of the cylinder 30 near the end closest to the piston opening 110. The pivot lugs 52,54 provide means for pivotable support by the front and rear frame members 14,16. The pivot lugs 52,54 ride in the cup-shaped apertures 48,50 in both the front and rear members 14,16. Fluid passages 112,114, drilled vertically into the center of each lug, communicate with fluid passages 89,91 respectively in the front and rear frame members 14,16.

Included within one piston in one of the cylinders 30 is a by-pass valve 134 to prevent over travel of all pistons. FIG. 6 illustrates the piston containing the bypass valve 134. By-pass valve 134 is located in a central bore 136 in the piston 40. On the pressure side 138 of the piston 40 the bore 136 opens and is conically shaped to mate with a spindle 140 having a conical head 142. The conical head 142 is biased against the bore 136, and an O-ring 144, by means of a tension spring 146. The spring 146 is anchored by a pin 148 through a hole in the piston 40. The ends of the hole are silver brazed to prevent leakage therethrough. The spring 146 is attached to the spindle 140 by means of a hooked end 150. When the piston 40 reaches the end of its travel, a second pin 152 extending through a slot 154 in the piston 40 and cooperating with the spindle 140, engages the piston end seal 194. This causes pin 152 to slide in the slot 154 and push back the spindle 140 to allow fluid to flow from the pressure side 138 through the bore 136 and slot 154, into the return side 196 and out passage 114. This effectively relieves the pressure in the entire system.

As can be most clearly seen in FIG. 3, the pivot lugs 52,54 of a cylinder 30 are received in apertures 48, 50. Bearings 132 are provided around each of the pivot lugs in order to facilitate rotation of the cylinders 30. Sealing the apertures 48, 50 on the outside of the frame are cylinder pressure caps 122. The cylinder pressure caps 122 are provided with small passages in order to allow fluid to flow from square passage 89 in the front frame member 14 to the cylinders 30 and from the cylinders 30 to square passage 91 in the rear frame member 16. A number of o-rings 124 are provided with the cylinder pressure caps 122 to prevent leakage of fluid. In order to prevent leakage at the rotating joint between the cylinder pressure cap 122 and the pivot lugs 52, 54, a shear seal 126 is provided. Shear seal 126 comprises a small, generally cylindrical rubber washer 128 which is biased against the associated pivot lug 52, 54 by means of wave-spring washer 130. When pressurized fluid passes through the center of the shear seal, a small amount will collect in the void provided for the wave-spring washer 130. This provides an additional force to squeeze the rubber washer 128 against the pivot log and ensures a leak-proof joint.

Figure 7:
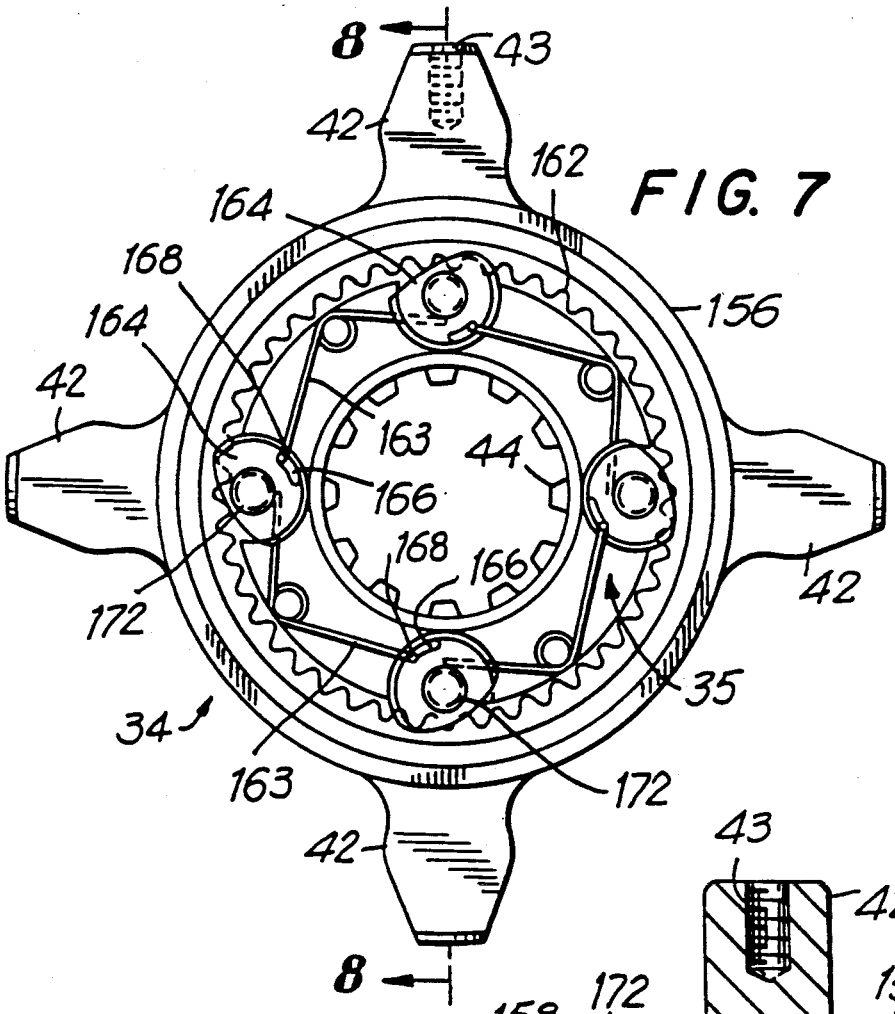
FIG. 7 is a top plan view of the four-leg ratchet mechanism of the present invention.
Figure 8:
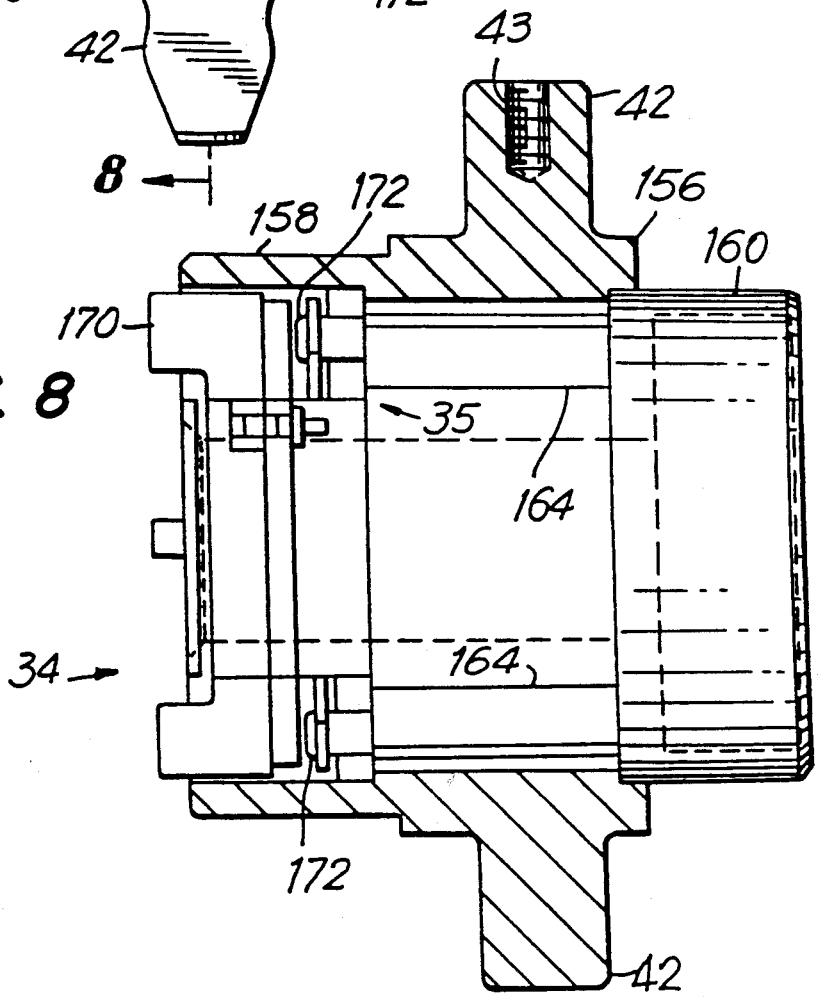
FIG. 8 is a section view through line 8—8 of FIG. 7.

The means for converting the linear motion of the hydraulic cylinders 30 to angular motion in order to apply torque is the four-leg ratchet mechanism 34, shown in detail in FIGS. 7 and 8. Ratchet mechanism 34 comprises a generally cylindrical body 156 having four legs 42 extending therefrom. A threaded hole 43 is provided in one of the legs to allow attachment of a threaded rod 45 which links the four-leg ratchet to the return springs 28, 29 (shown in FIG. 2). The legs 42 are equally spaced ninety (90) degrees apart around the circumference of the cylindrical body 156. The arrangement of the legs 42 ensures that the forces applied by the hydraulic cylinders 30 are equal and opposite forces, applied in a diametrically opposed manner such that the stability of the wrench 10 in performing a torquing operation is greatly enhanced.

The upper and lower smooth bearing surfaces 158,160 of the cylindrical body 156 ride respectively on front and rear bearings 100, 102 (shown in FIG. 3) disposed in central opening 60 of the front and rear frame members 14,16.

Teeth 162 surround the inner circumference of the cylindrical body 156. Teeth 162 cooperate with a full floating pawl mechanism 35 to provide the ratchet effect of the four-leg ratchet mechanism 34. Because the pistons 40 have a limited stroke, the angle through which the four-leg ratchet mechanism moves in a single stroke is limited. The four-leg ratchet mechanism 34 thus provides for ratcheting back for a subsequent stroke in the same direction without manually setting the wrench. To assist in ratcheting back the mechanism 34, two return springs 28,29 are provided. Only one spring is used at a time, which spring depends on whether a torquing or untorquing operation is being performed. The springs 28,29 are fastened at one end to a cylinder 30 and at the opposite end to threaded rod 45 which is screwed into one leg of the four-leg ratchet mechanism 34. In FIG. 2 spring 29 is the active spring. Thus, when the pistons 40 extend, causing the four-leg ratchet mechanism 34 to rotate clockwise, spring 29 extends. The biasing force of spring 29 then causes the four-leg ratchet mechanism 34 to ratchet back with the return stroke of the piston 40.

The full floating pawl mechanism 35 comprises four pawls 164 located ninety (90) degrees apart in order to fully engage the teeth 162. By providing the teeth 162 on an inside surface, with the pawls 164 in the interior, the arrangement provides a roll-in or self-locking action which will ensure effective engagement even if the pawl springs 163 become weakened. Extending up through a small arched slot 166 in each pawl is a pin 168 which communicates with the reverse knob 170 which is removed in FIG. 7 to reveal the pawl mechanism.

The reverse knob 170 is shown in FIGS. 1, 2 and 8. When selecting between torquing and untorquing operations, the reverse knob 170 is rotated to position the pawls 164 for proper engagement with the teeth 162. The pins 168 engage the end of the arched slot 166 and rotate each pawl 164 around the pawl screw 172 to cause the pawls 164 to change position. The pawl springs 163 maintain the pawls 164 in position once the reverse knob 170 is rotated. A spline 44 forms the inside of the pawl mechanism. The spline 44 is adapted to securely hold a tool, such as a hexagonal socket, for turning a nut or other piece to be torqued.

Figure 9:
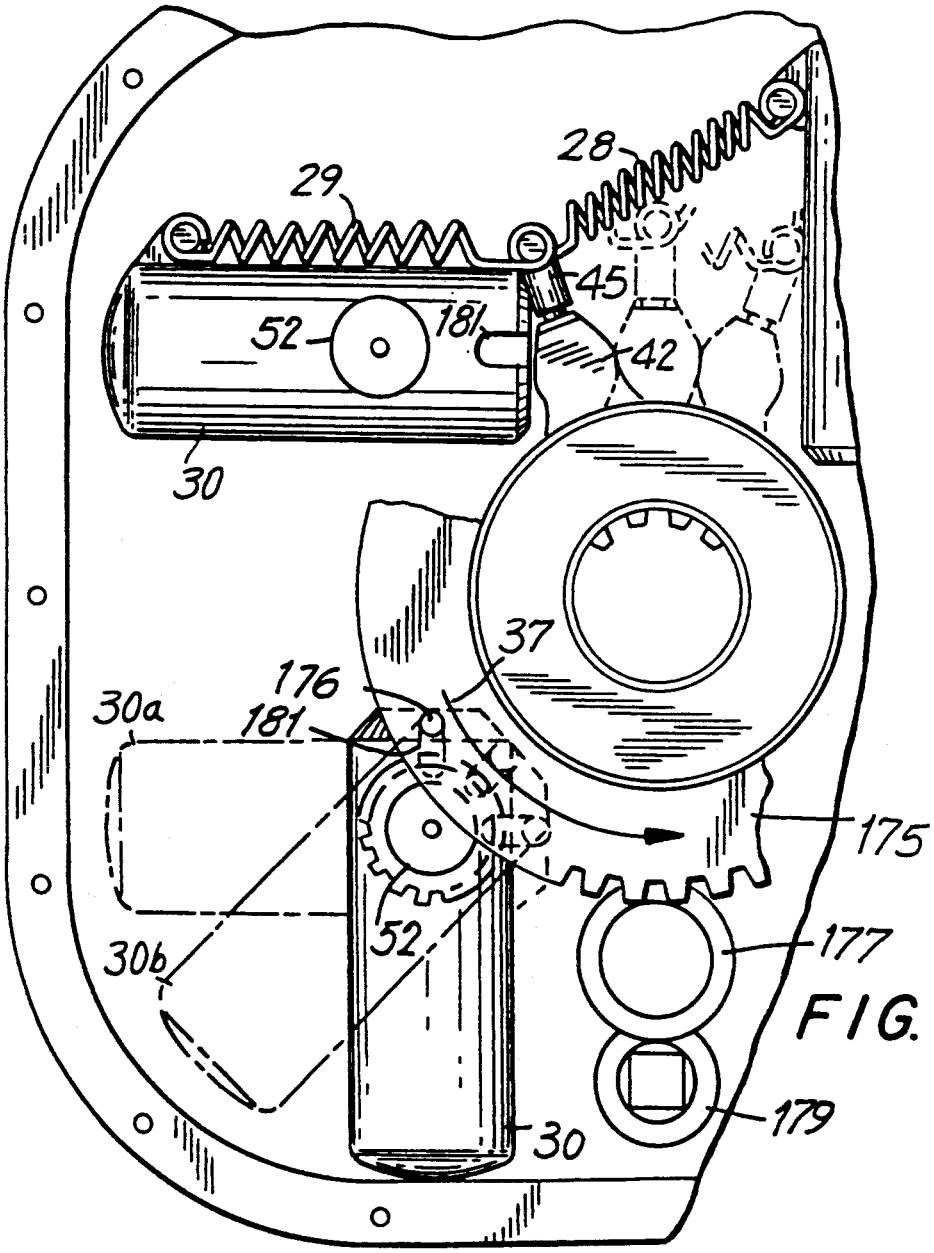
FIG. 9 is a partial top plan view with the outer surface of the wrench broken away to reveal the drive means and selector means for rotating the cylinders of the present invention.

Referring now to FIG. 9, the means for rotating the cylinders 30 is described in detail. The cylinders 30 are mounted pivotably in apertures 48,50 in the front and rear frame members 14,16. A rotable ring 175, having perpendicularly extending pins 176, is provided at the center of the wrench 10. The ring 175, is provided with gear teeth and may be rotated by means of an idler gear 177 driven by drive gear 179. The drive gear 179 has a square socket which accepts the pump handle 22. The pins 176 communicate with slots 181 located at the top front end of each cylinder 30. The engagement of the pins 176 in the slots 181 is best seen in FIG. 3. When the ring 175 is rotated by the drive gear 179, the pins 176 move in a circular direction, indicated by arrow 37, engaging the slots 181 and causing rotation of the cylinders 30 about the pivot lugs 52,54. Cylinders 30*a* and 30*b*, shown in phantom, indicate the initial and intermediate positions through which a cylinder passes when rotated. Once the cylinders 30 reach their limit of travel in either direction, a spring biased plunger mechanism 183 (shown only in FIG. 1) locks the drive gear 179 in place by engaging a hole in the drive gear shaft. The plunger mechanism 183 maintains the cylinders 30 at the correct orientation for a torquing or untorquing operation, and prevents the spring-loaded cylinders from counteracting the desired cylinder position.

Figure 10:
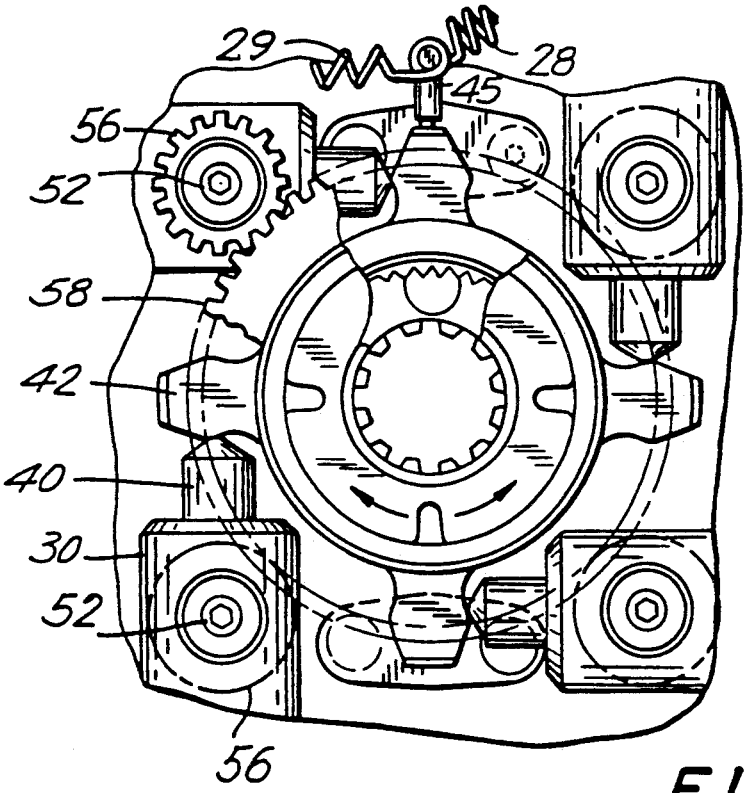
FIG. 10 is a partial top plan view of the present invention similar to FIG. 9, but showing an alternative embodiment for rotation of the cylinders.

FIG. 10 illustrates an alternative embodiment of the means for rotating the cylinders 30. In this embodiment spur gears 56 are rigidly mounted on the top pivot lug 52 of each cylinder 30. A sun gear 58 surrounds the central opening 60 of the wrench 10 and cooperates with the spur gears 56. Rotation of the sun gear 58 causes rotation of the cylinders 30 to the desired position.

Figure 11:
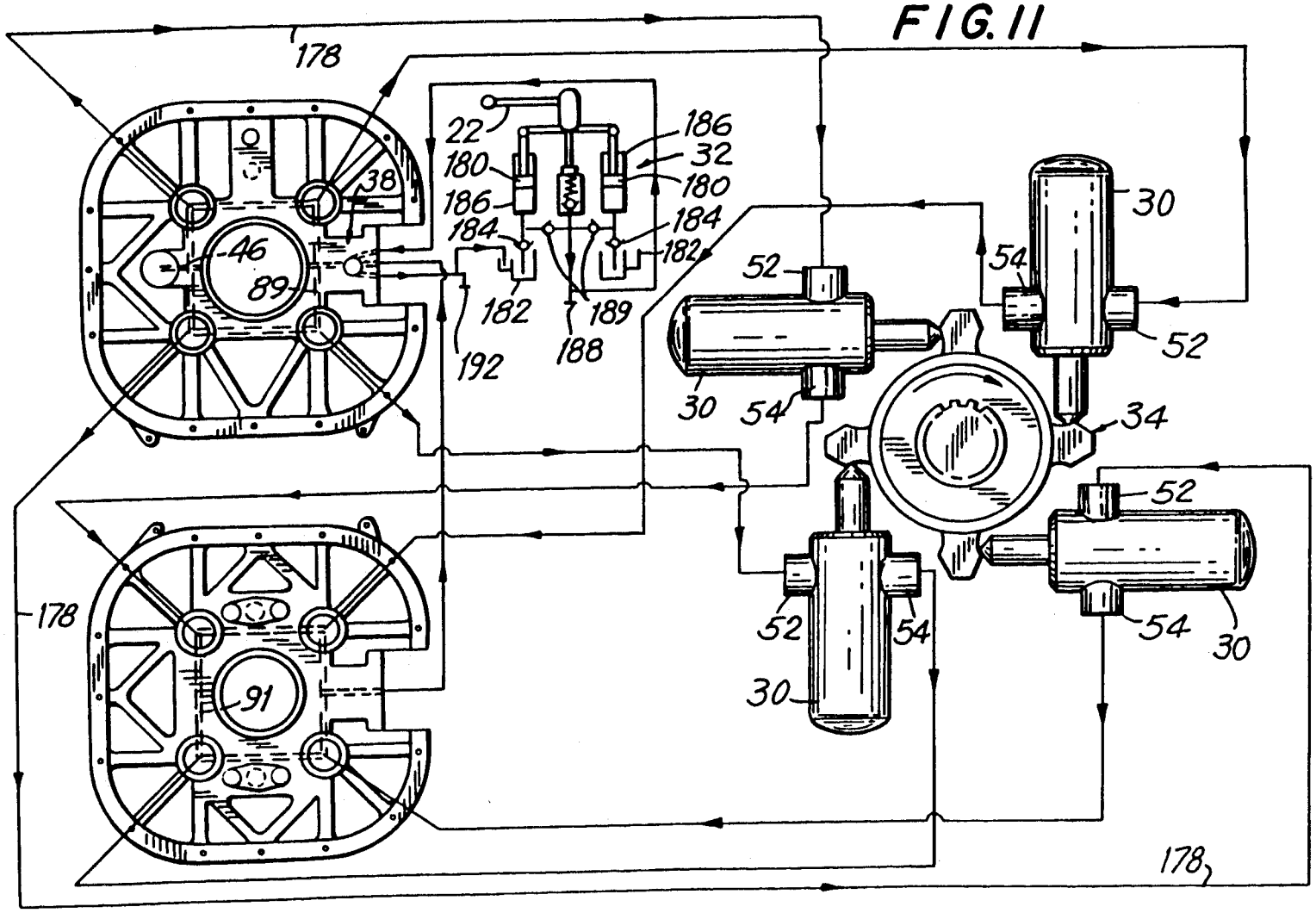
FIG. 11 is a schematic view of the fluid power circuit of the present invention.

The fluid power circuit of the wrench is shown in FIG. 11. In this figure, the cylinders 30 are broken out of the front and rear frame members 14,16 and direct fluid connections are indicated by arrow lines 178. The arrows indicate the direction of fluid flow in the pressure/torquing operation. In the preferred embodiment of the present invention, the preferred actuating fluid is hydraulic fluid. The selection of a specific hydraulic fluid is well with the skill of those of ordinary skill in the art. It will also be readily apparent to those skilled in the art that the teachings of the present invention are equally applicable to the use of other actuating fluids which are commonly used in the art, such as air. Also, in the preferred embodiment, a dual action pump 32 provides the pressurized fluid for the system. Pumping of the handle 22 causes the pump pistons 180 to be alternately raised and lowered. The raising of a piston 180 draws fluid from the reservoir 182, through check valves 184 and into the cylinder 186. When the piston 180 is lowered, the incompressible fluid is forced through second check valves 189 and into the four-way selector valve 38.

Figure 12:
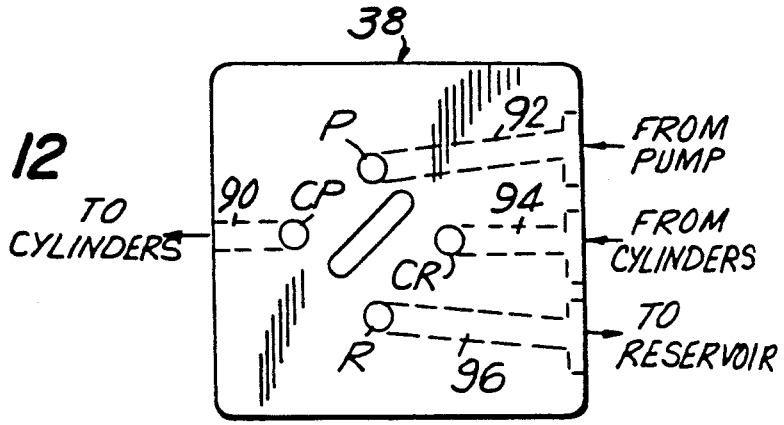
FIG. 12 is a detail schematic view of the selector valve of the present invention.

The four-way selector valve is shown in detail in FIG. 12. Passages 90-96 correspond to those shown in FIG. 4. The fluid enters the pressure (P) port of the valve 38 and the valve spindle directs it to the cylinder pressure (CP) port for a torquing stroke of the pistons, or to the cylinder return (CR) port for a return stroke after application of torque. Fluid from the pressure (P) port is directed to the return (R) port for the normal open position between torquing and return strokes. Thus, in the normal open position, all pressure in the cylinders and reservoir is in equilibrium with the atmosphere. The selector valve 38 is shown in the pressure/-torquing position. From the CP port the fluid is distributed to the cylinders through the fluid passages 90, 89 in the front frame member 14.

The fluid enters the cylinders 30 on the pressure side 138 through the passages 89 in the front frame member 14. The fluid, under pressure from the pump 32, fills the cylinder pressure sides 138 behind the pistons 40 and causes the extension of the pistons 40 (see FIG. 6). The pistons 40 then cooperate with the four-leg ratchet mechanism 34 to impart torque to the work piece. The fluid which resided on the return side 196 of the piston 40 is forced out through the return passages 114 in the bottom pivot lug 54 of each cylinder 30. From the bottom pivot lug 54 the fluid flows through passage 91 in the rear frame member 16 to passage 94. From this point the fluid flows to the CR port of the selector valve 38 which communicates with the R port and leads to the reservoir 182 by passage 96. The wrench 10 is therefore provided with a closed hydraulic system which does not require outside fluid or pressure systems. This reduces the possibility of contamination to the system. External pressure 188 and return 192 ports are also provided on the pump in case it is desired to use an outside, auxiliary power pump if high speed torquing and untorquing operations are required.

When the pistons reach their full extension, the bypass valve 134 in one cylinder is actuated and allows fluid to flow around the piston seal 194 to prevent damage to the wrench 10 by over travel of the pistons.

To return the piston 40 after the torque stroke, the selector valve 38 is rotated first to the normal open position to allow the system pressure to stabilize. The valve 38 is then rotated to the return position and the flow in the system is reversed from that described above. The pressurized fluid then enters the return side 196 of the piston 40 and forces the piston 40 back into the cylinder 30.

The torque applied by the wrench 10 is indicated on the transducer pressure gauge 36. A transducer in the gauge 36 communicates with the fluid passage 89 of the pressure side of the hydraulic circuit in the frame front member 14 by means of a small pilot hole 46. The gauge 36 is calibrated to convert pressure readings from the system to torque readings in a digital display. With a known piston area the pressure may be converted to force and then multiplied by the effective moment arm to give the torque applied. This is accomplished electronically with great precision by the gauge 36. For this reason, prior art wrenches, which may have a slightly eccentrically applied load as discussed above in the Background section, could produce widely varying torque readings. The gauge 36 may be provided with additional features such as the ability to switch between torque and pressure readings and an alarm to indicate when the desired torque is reached.

A alternate method of measuring torque is with the use of the 180-0-180 degree protractor 174 which is slidably mounted on the outside of the front frame member 14. This is best seen in FIG. 1. The protractor 174 is used in conjunction with a dial indicator (not shown) to measure torque by the shaft stretch method. The end of a shaft or nut which the torque wrench 10 engages is accessible through the central opening 60. Thus, a line may be scribed on the end of the nut or shaft, aligned with 0° on the protractor 174. Also, the dial indicator may be positioned against the shaft end at that location. Initially, a preload torque of about 100 ft. lbs. is applied to take up the slack clearance and tolerances in the internal parts of the wrench 10 and in the parts being torqued. After the preload torque is applied, the dial indicator is set to zero and the protractor 174 rotated slightly to realign 0° with the scribed line. The protractor 174 may then be secured in place by screws 171. When the final torque is applied the nut or shaft will stretch with the movement indicated on the dial indicator as well as by the rotation of the scribed line relative to the protractor 174. These values may be compared with standard tables or graphs supplied by the manufacturer of the assembly being torqued to determine the torque applied based on the physical properties of the materials involved. This alternate method may be used in conjunction with gauge 36 in applications requiring particularly high precision.

The method of operation with wrench 10 may thus be summarized as follows:

1. Install the proper adapter tooling, comprising a spline drive bar adapted to fit into the splined ring 44 of the four leg ratchet mechanism 34 and accept the piece to be torqued. Also install the torque reaction adapter which is fitted onto the back of the wrench 10 and secured by the shear legs 106. The wrench is then placed on the part being torqued;

2. Rotate the cylinder drive gear 179 to position the cylinders 30 for clockwise or counterclockwise rotation as desired. The pistons 40 must be fully retracted before the rotation of the cylinders 30;

3. Rotate the reverse knob 170 to the proper position to ensure engagement of the pawls 164 for the direction of torque desired. For a clockwise torquing operation, for example, the reverse knob 170 must be rotated counterclockwise to engage the pawls 164;

4. Rotate the selector valve 38 to the cylinder pressure position to provide a torque stroke of the pistons 40;

5. Actuate the pump 32 to provide pressurized fluid to the cylinders 30;

6. Upon reaching the desired torque, or full extension of the pistons 40, stop pumping and rotate the selector valve 38 first to the normal open position to stabilize pressure in the system and then to the cylinder return position in order to direct the fluid for a return stroke of the pistons 40;

7. Actuate the pump 32 to return the pistons 40;

8. Return the selector valve 38 to the normal open position;

9. Repeat steps four (4) to eight (8) until the desired torque is achieved.

As will be apparent to persons skilled in the art, various modifications and adaptations of the structure above described will become readily apparent without departure from the spirit and scope of the invention, the scope of which is defined in the appended claims.

What is claimed is:

1. A torque wrench for applying torque to an article, comprising:

a frame defining a central aperture concentric with a central vertical axis;

drive means for converting linear force applied to said drive means to angular force and for engaging such article, said drive means being supported by the frame in said central aperture for rotation about the central vertical axis; and means for applying two pairs of equal and diametrically opposed linear forces to said drive means, said linear forces being at least approximately equally spaced around said central aperture whereby said wrench provides at least a four-point stabilized torquing force.

2. A torque wrench according to claim 1, further comprising selector means for selectively rotating the direction of application of said force-applying means, said selector means mounted in said frame and cooperating with said force-applying means, thereby providing a centrally balanced torque wrench capable of successively torquing in a clockwise and counterclockwise direction without removing or turning over the wrench.

3. A torque wrench, comprising:

a frame;

drive means for converting linear force applied to said drive means to angular force and for engaging a device to be rotated, said drive means mounted centrally in said frame;

means for applying linear forces to said drive means; and selector means for rotating the direction of application of said force-applying means, said selector means mounted in said frame and cooperating with said force-applying means, thereby providing a torque wrench capable of successively torquing in a clockwise and counterclockwise direction without removing or turning over the wrench.

4. A torque wrench according to claim 1, wherein said force-applying means comprises:

four fluid power cylinders disposed on the frame in opposed pairs acting through parallel lines spaced perpendicularly apart across the central aperture, said cylinders engaging said drive means and applying equal, diametrically opposed linear forces thereto; and means for supplying actuating fluid to the cylinders.

5. A torque wrench according to claim 4, wherein said drive means comprises:

a generally cylindrical body defining a central bore with a gear-toothed interior surface and having four legs extending radially from and equally spaced around the outer circumference of the cylindrical body;

a ratchet wheel rotatably supported within the central bore and adapted to engage a tool for connection with the device to be rotated; and a plurality of pawls pivotably supported on the ratchet wheel, said pawls biasly engaging the gear-toothed interior surface of the central aperture and each being selectively movable between a first position, to provide driving engagement between the body and the ratchet wheel in a clockwise direction, and a second position to provide driving engagement in a counter-clockwise direction.

6. A torque wrench according to claim 5, further comprising selector means for selectively rotating the direction of application of the cylinders of said force-applying means, said selector means mounted in said frame and cooperating with the cylinders, thereby providing a centrally balanced torque wrench capable of successively torquing in a clockwise and counterclockwise direction without removing or turning over the wrench.

7. A torque wrench according to claim 6, wherein said selector means comprises:

a ring rotatably mounted on the frame, said ring being rotatable about said vertical axis; and a plurality of pins extending substantially perpendicularly from one side of the ring, one of said pins slideably cooperating with each of the cylinders to rotate the cylinders when the ring is rotated.

8. A torque wrench according to claim 6, wherein said selector means comprises:

a plurality of spur gears, one of said spur gears rigidly mounted on each cylinder; and a sun gear ring rotatably mounted on the frame and engaging the spur gears to rotate the cylinders when the sun gear is rotated.

9. A torque wrench according to claim 6, having four said cylinders, wherein said cylinders are evenly spaced on the frame to apply equal and opposite diametrically opposed forces to the legs of the drive means and the pistons engage the legs at points equidistant from the central vertical axis of the drive member.

10. A torque wrench according to claim 4, wherein the fluid supply means comprises:

internal fluid supply lines formed integrally with the frame and communicating with the cylinders;

means for providing actuating fluid under pressure, said fluid providing means communicating with said supply lines; and a selector valve for selectively directing actuating fluid under pressure to the cylinders through said supply lines in order to provide a power stroke and a return stroke of the pistons, and further to provide a pressure stabilized normally open state for the fluid supply means.

11. A torque wrench according to claim 10, wherein the actuating fluid is hydraulic fluid.

12. A torque wrench according to claim 10, wherein the actuating fluid is air.

13. A torque wrench according to claim 10, wherein the pressure means comprises an external fluid power pump communicating with the fluid supply lines.

14. A torque wrench according to claim 11, wherein the pressure means comprises:

a pump communicating with the fluid supply lines, providing hydraulic fluid under pressure; and a reservoir integral with the pump for containing the hydraulic fluid supply, whereby the wrench is provided with an entirely self-contained hydraulic system.

15. A torque wrench, comprising:

a frame defining a central aperture;

drive means for converting linear force applied to said drive means to angular force and for engaging a device to be rotated, said drive means rotatably supported by the frame in the central aperture and rotatable about a first axis generally perpendicular with respect to the frame, said drive means being provided with a plurality of equally spaced radially extending legs;

a plurality of fluid power cylinders provided as opposed pairs acting through parallel lines spaced equidistantly apart across the central aperture, said cylinders being pivotably supported on the frame in an evenly spaced relationship to each other and rotatable about axes parallel to the first axis, each cylinder having a piston capable of alternately engaging one of two adjacent legs of said drive means at points equidistant from the first axis and applying force to the engaged leg in a direction perpendicular to the first axis, said evenly spaced relationship of opposed pairs providing the application of equal, diametrically opposed forces by said pistons to rotate said drive means;

means for supplying fluid to the cylinders to cause the pistons to exert force on and rotate the drive means;

a pressure gauge communicating with the fluid supply means; and selector means for rotating the cylinders about the pivot supports to alternately select the leg of said first means with which the piston engages, thereby selecting the direction of rotation of said first means.

16. The torque wrench as in claim 15, wherein the frame comprises first and second metal frame members, each said member comprising a central support member defining the central aperture and further defining passages therethrough for actuating fluid, and individual structural truss members joining the central support member with an outer ring member and defining voids therebetween, thereby minimizing the weight of the frame.

17. The torque wrench as in claim 15, wherein:

the actuating fluid is hydraulic fluid; and the fluid supply means comprises a dual acting hydraulic pump having a self-contained hydraulic reservoir communicating with the cylinders and pressure gauge, and a hydraulic selector valve for selectively directing fluid from the pump to the cylinders to provide a power stroke and return stroke of the pistons.

18. The torque wrench as in claim 15, wherein the selector means comprises:

a ring rotatably mounted on the frame, said ring being rotatable about said first axis; and a plurality of pins extending substantially perpendicularly from one side of the ring, each pin slideably cooperating with slots defined by the upper side of the cylinders.

19. The torque wrench according to claim 15, wherein:

the number of radially extending legs on said drive means is four with said legs being located 90° apart; and the number of fluid power cylinders is four with said cylinders being located 90° degrees apart.

20. A torque wrench, comprising:

a frame, including two metal frame members, each member comprising a central support member defining a central aperture and defining passages therethrough adapted for the passage of hydraulic fluid, and a plurality of structural truss members joining the central support member;

drive means for converting linear force applied to said drive means to angular force and for engaging a device to be rotated, said drive means supported by the frame in the central aperture and comprising a generally cylindrical body defining a circular bore around a central vertical axis, a gear-toothed interior surface inside said cylindrical body, four legs extending radially from and equally spaced around the outer circumference of said cylindrical body, a ratchet wheel rotatably supported within the circular bore and adapted to hold a tool for engaging the device to be rotated, and a plurality of pawls pivotaly supported on the ratchet wheel, said pawls biasly engaging the gear-toothed interior surface of the central bore and each pawl being selectively movable between a first position to provide driving engagement between the body and the ratchet wheel in a clockwise direction, and a second position to provide driving engagement in a counterclockwise direction;

four hydraulic cylinders pivotably supported on the frame around said drive means in an evenly spaced relationship to each other and communicating with the fluid passages, each cylinder having a piston capable of alternately engaging one of two adjacent legs of the drive means to rotate said drive means and said four cylinders being evenly spaced on the frame to apply equal, diametrically opposed forces to the legs of said drive means, and said pistons engaging said legs at points equidistant from the central axis of the drive means;

a self-contained hydraulic system for actuating the pistons to exert force on and rotate the drive means, said system comprising a pump communicating with the fluid passages and providing hydraulic fluid under pressure, said pump having an integral resevoir for containing the hydraulic fluid supply, and said system further comprising a selector valve communicating with the fluid passages for directing the flow of hydraulic fluid;

a transducer pressure gauge communicating with the fluid passages and calibrated to indicate the torque applied to the device to be rotated; and selector means for rotating the cylinders about the pivot supports to alternately select the leg of the drive means with which the piston engages, said selector means comprising a ring surrounding the central aperture of the frame;

four equally spaced pins extending substantially perpendicularly from one side of said ring and engaging corresponding slots in the cylinders, and a drive gear cooperating with said ring, whereby rotating of the drive gear causes rotating of the cylinders and the direction of rotation of the drive means is thereby selected.

21. A method for applying torque to an article, with a torque wrench comprising a frame defining a central aperture and defining passages therethrough adapted for the passage of hydraulic fluid; drive means for converting linear force to angular force and for engaging the article to be torqued, said drive means supported by the frame in the central aperture and including a cylindrical body with four radially extending legs and a plurality of pawls pivotally supported on a ratchet wheel in said body, said pawls biasly engaging a gear-toothed interior surface of the body and each pawl being selectively movable between a first position to provide driving engagement between the body and the ratchet wheel in a clockwise direction, and a second position to provide driving engagement in a counter-clockwise direction; four hydraulic cylinders pivotably supported on the frame around said drive means in an evenly spaced relationship to each other, each cylinder having a piston capable of alternately engaging one of two adjacent legs of the drive means to rotate said drive means; a self-contained hydraulic system for actuating the pistons to exert force on and rotate the drive means, said system comprising a pump communicating with the fluid passages and a selector valve communicating with the fluid passages for directly the flow of hydraulic fluid; and selector means for rotating the cylinders about the pivot supports to alternately select the leg of the drive means with which the piston engages to achieve a desired torquing direction, said method comprising the steps of:

installing the torque wrench on the article;

rotating the cylinders with the selector means to position the pistons for torquing in the desired direction;

engaging the pawls of the drive means for transmitting torque in the desired direction;

positioning the selector valve to direct the hydraulic fluid for a torque stroke of the pistons;

actuating the pump to force hydraulic fluid under pressure into the cylinders, thereby extending the pistons and applying equal and diametrically opposed linear forces to the article through the drive means, said drive means converting the linear force to torque;

positioning the selector valve to stabilize, pressure in the hydraulic system and allowing the system pressure to stabilize at atmosphere pressure;

positioning the selector valve for a return stroke of the pistons; and actuating the pump to force hydraulic fluid under pressure into the cylinders, thereby returning the pistons into the cylinders.

22. A method for applying torque to an article comprising the steps of:

applying two pairs of equal and diametrically opposed linear forces to the article, approximately equally spaced around the article; and converting said linear forces to angular forces and thereby applying centrally balanced torque to the article without inducing side loading.

23. The method of torquing according to claim 22, further comprising the step of selectively rotating the direction of application of said linear forces in order to selectively apply torque in a clockwise or counterclockwise direction.

24. A torque wrench, comprising:

a frame defining a central aperture concentric with a central vertical axis;

drive means for converting linear force applied to said drive means to angular force and for engaging a device to be rotated, said drive means being rotatably supported by the frame in said central aperture and rotatable about the central vertical axis, said drive means including a generally cylindrical body defining a central bore with a gear-toothed interior surface and having four legs extending radially from and equally spaced around the outer circumference of the cylindrical body, a ratchet wheel rotatably supported within the central bore and adapted to engage a tool for connection with the device to be rotated, and a plurality of pawls pivotably supported on the ratchet wheel, said pawls biasly engaging the gear-toothed interior surface of the central aperture and each being selectively movable between a first position, to provide driving engagement between the body and the ratchet wheel in a clockwise direction, and a second position to provide driving engagement in a counter-clockwise direction;

means for applying equal and diametrically opposed linear forces to said drive means, including a plurality of fluid power cylinders disposed on the frame in opposed pairs acting through parallel lines spaced perpendicularly apart across the central aperture, said cylinders engaging said drive means and applying equal, diametrically opposed linear forces thereto, and means for supplying actuating fluid to the cylinder; and selector means for selectively rotating the direction of application of the cylinders of said force-applying means, said selector means mounted in said frame and cooperating with the cylinders, thereby providing a centrally balanced torque wrench capable of successively torquing in a clockwise and counterclockwise direction without removing or turning over the wrench.

25. A torque wrench according to claim 24, wherein said selector means comprises:

a ring rotatably mounted on the frame, said ring being rotatable about said vertical axis; and a plurality of pins extending substantially perpendicularly from one side of the ring, one of said pins slideably cooperating with each of the cylinders to rotate the cylinders when the ring is rotated.

26. A torque wrench according to claim 24, wherein said selector means comprises:

a plurality of spur gears, one of said spur gears rigidly mounted on each cylinder; and a sun gear ring rotatably mounted on the frame and engaging the spur gears to rotate the cylinders when the sun gear is rotated.

27. A torque wrench according to claim 24, having four said cylinders, wherein said cylinders are evenly spaced on the frame to apply equal and opposite diametrically opposed forces to the legs of the drive means and the pistons engage the legs at points equidistant from the central vertical axis of the drive member.

28. A method for applying torque to an article comprising the steps of:

applying equal and diametrically opposed linear forces to the article;

converting said linear forces to angular forces and thereby applying torque to the article without including side loading; and selectively rotating the direction of application of said linear forces in order to selectively apply torque in a clockwise or counterclockwise direction.

* * * * *